US005966302A

United States Patent [19]

Chrosny et al.

[11] Patent Number: 5,966,302

[45] Date of Patent: Oct. 12, 1999

[54] SHEET PROCESSING SYSTEM WITH NEURAL NETWORK CONTROL

[75] Inventors: Wojciech M Chrosny, Orange; Khosrow Eghtesadi, Shelton, both of Conn.

[73] Assignee: Pitney Bowes Inc., Stamford, Conn.

[21] Appl. No.: 07/961,795

[22] Filed: Oct. 16, 1992

[51] Int. Cl.[6] ..... G05B 13/02

[52] U.S. Cl. ..... 364/148.03; 364/471.01

[58] Field of Search ..... 364/468, 470, 364/471, 478, 148.03, 471.01, 471.02; 395/116

[56] References Cited

U.S. PATENT DOCUMENTS

| | | | |
|---|---|---|---|
| 4,516,210 | 5/1985 | Dahlke | 364/471 |
| 4,757,984 | 7/1988 | Rowe et al. | 364/470 |
| 4,821,203 | 4/1989 | Carlton et al. | 364/478 |
| 4,920,487 | 4/1990 | Baffes | 364/300 |
| 4,933,616 | 6/1990 | Chang et al. | 364/471 |
| 5,058,180 | 10/1991 | Kahn | 382/14 |
| 5,100,120 | 3/1992 | Kikuchi et al. | 271/22 |
| 5,207,412 | 5/1993 | Coons, Jr. et al. | 364/478 |
| 5,210,823 | 5/1993 | Moroi | 395/116 |
| 5,251,554 | 10/1993 | Eckert, Jr. et al. | 364/471 |

OTHER PUBLICATIONS

D. Seidl, T. Reineking, R. Lorenz, Use of Neu. Net. To Ident. and Comp. for Fricton in Precision, Position Cont. Mechanisms.

J. Zurada, Introduction to Artificial Neural Systems, pp. 33–38.

D. Wenskay, Intellectual Property for Neural Networks, Aug. 11, 1989, pp. 229–236.

European Search Report, Feb. 10, 1994.

Patent Abstract of Japan, vol. 007, No. 215 (M–244) Sep. 22, 1983.

Patent Abstracts of Japan, JP–A–58 109 340, (Komatsu Seisakusho) Jun. 29, 1983.

*Primary Examiner*—William Grant

*Attorney, Agent, or Firm*—Ronald Reichman; Melvin J. Scolnick; Brigitte L. Jeffery

[57] ABSTRACT

A sheet processing apparatus, which may be a mailing machine, inserter or similar system for producing mail pieces or may be a copier or printer or the like. The system includes a control mechanism for reducing the likelihood of jams as sheets are fed through a sheet handling apparatus included in the system. Preferably the control mechanism will include a neural network trained to response to a characteristic signal generated by a sheet feeder as a sheet is input to the apparatus. After training the network will produce a control signal output for controlling the processing rate of the apparatus to reduce the rate if there is a likelihood that the input sheet will jam. The network may also produce an outstacking signal for diverting sheets, in extreme cases, for corrective action. The drive current of a motor used to output the sheet from a sheet feeder is monitored to provide the characteristic signal which is sampled as an input to the network. An additional signal representative of an external condition, such as temperature or humidity or operating history, may also be input to the network.

1 Claim, 8 Drawing Sheets

SHEET PROCESSING SYSTEM WITH NEURAL NETWORK CONTROL

BACKGROUND OF THE INVENTION

The subject invention relates to sheet processing systems such as mailing machines, inserters printers, copiers and similar equipment for handling sheets of paper, envelopes and other sheet-like materials (herein after referred to generally as sheets). More particularly, it relates to such systems which include a control mechanism for avoiding jams.

Equipment such as mailing machines, which seal envelopes and imprint them with postage indicia, inserters, which insert materials into envelopes to form mail pieces, and other forms of sheet handling equipment are well known, and are generally satisfactory for their intended purpose. However, from time to time a sheet, perhaps because it is oversized or damaged, will jam in the sheet processing system. This is highly disadvantageous since the time needed to clear the jam will greatly reduce the overall throughput of the system. Perhaps more importantly, were the jammed sheet is preprinted or otherwise unique (e.g. as in systems for the return of cancelled checks) it may be destroyed when it is jammed and its replacement may be difficult or impossible. Also, in a system where a number of sheets are to be assembled in order, a jammed sheet may cause great difficulty in restoring the desired order.

Thus, it is an object of the subject invention to provide a sheet handling system which includes a control mechanism for reducing the likelihood of jams.

BRIEF SUMMARY OF THE INVENTION

The above object is achieved and the disadvantages of the prior art are overcome in accordance with the subject invention by means of a sheet processing system which includes a sheet handling apparatus, which may be a mailing machine, and inserter, or other system for producing mail pieces, or may be a printer, or copier, or the like, and which includes an input for input of a control signal for determining the rate at which the apparatus processes sheets. The system further includes a sheet feeder for input of sheets to the apparatus, and the sheet feeder produces a signal during input of a sheet characteristics of the sheet. In one embodiment of the subject invention the signal may be the profile of the drive current for a motor which drives the sheet feeder. The system further includes a control mechanism responsive to the characteristic signal and connected to the control signal input for generating the control signal in accordance with the characteristic signal, so that the processing rate of the apparatus is reduced if the sheet is likely to jam in the apparatus.

In accordance with one embodiment of the subject invention the control mechanism includes apparatus for sampling the control signal at a predetermined sequence of times during input of the sheet, a store for storing a sequence of samples generated by the sampling apparatus, and a neural network connected to the store for generating the control signal as a function of the sequence of samples stored.

In accordance with another aspect of the subject invention the control mechanism includes a second output for controlling the apparatus to outstack (i.e. divert from the normal processing path for corrective action) sheets which are likely to jam no matter how slowly they are processed.

In accordance with still another aspect of the subject invention the control mechanism may be further responsive to an input representative of an external condition such as temperature, humidity, or the number of cycles of operation the system has performed.

In accordance with still another aspect of the subject invention the control mechanism is a neural network and the system further includes an apparatus responsive to jams in the system for further training of the neural network.

In operation the system of the subject invention monitors the characteristic signal and the control mechanism generates a control signal for controlling the processing rate of the apparatus in response to the characteristic signal so that the processing rate is reduced if the sheet is likely to jam in the apparatus.

DETAILED DESCRIPTION OF PREFERRED EMBODIMENTS OF THE SUBJECT INVENTION

Figure 1:
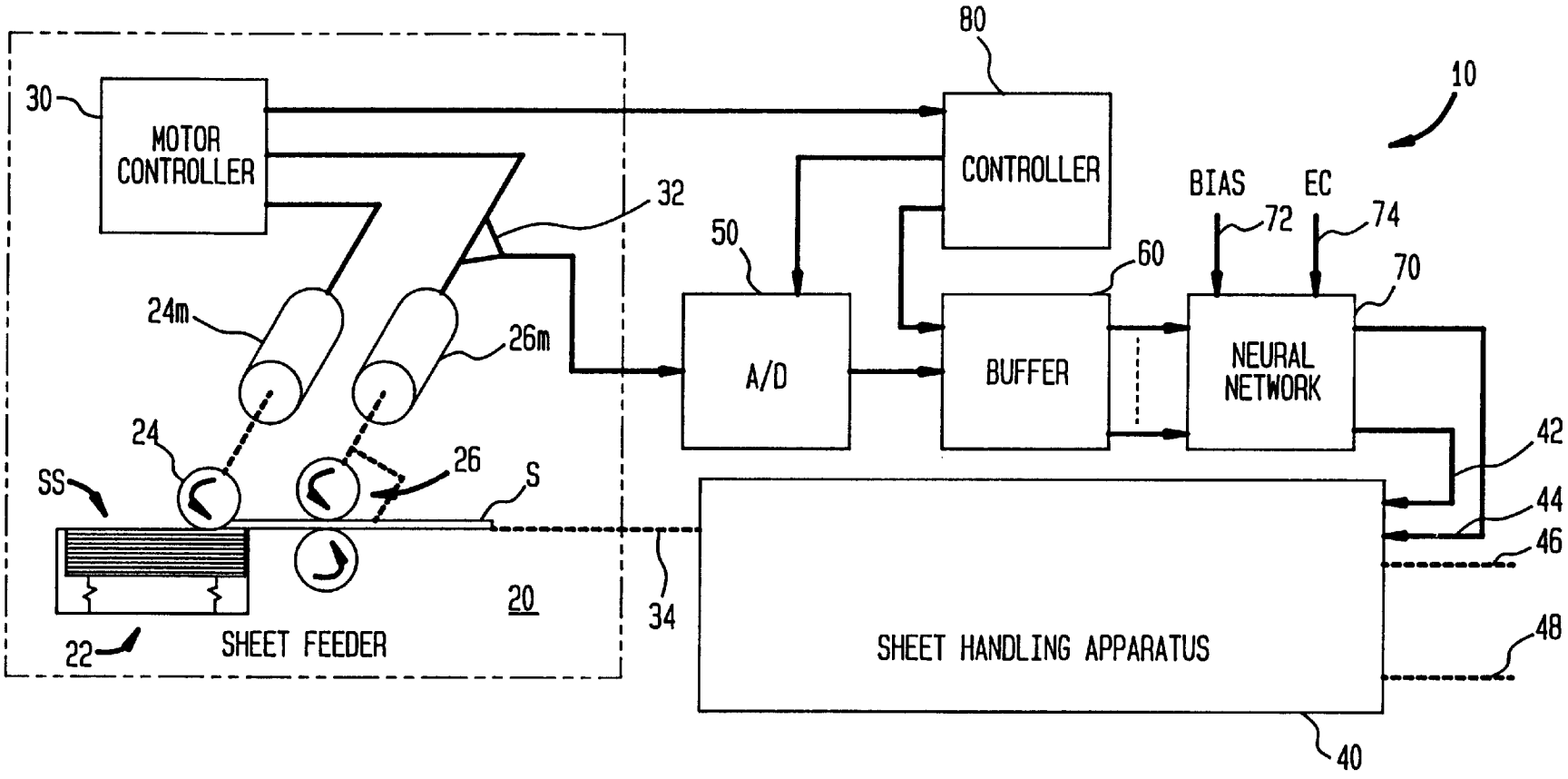
FIG. 1 shows a schematic block diagram of a system in accordance with the subject invention.

FIG. 1 shows a sheet processing system in accordance with the subject invention, which includes sheet feeder 20 for successively feeding sheets S from a stack of sheets SS. Typically, elevator 22 maintains stack SS in contact with pick-up roller 24 which is driven by motor 24M. Sheet S is then singulated by a separation device which may include a pair of counter rotating rollers 26, driven by motor 26M, for assuring that only a single sheet is fed from sheet feeder 20.

Motors 24M and 26M are driven by motor controller 30, and sheet feeder 20 is provided with sensor 32 for monitoring the drive current of motor 26M.

Those skilled in the art will recognize that sheet feeders are well known in the art and that the above description of sheet feeder 20 is highly generalized and intended as illustrative only. Accordingly, it will be understood that details of the design of sheet feeder 20 form no part of the subject invention.

Further, while a motor drive current such as is measured by sensor 32 is a preferred source of the characteristic signals used in the subject invention other signal sources are within the contemplation of the subject invention. Thus, the characteristics signal might be the drive current for motor 24M, or a combination of drive currents, or sheet feeder 20 might be provided with sensors for sensing the thickness or other dimensions of sheet S to generate a signal characteristic of sheet S. Sheet S is then input to sheet handling apparatus 40, which may be any conventional apparatus for physically processing sheets, such as a mailing machine or an inserter, and may also be apparatus such as a copier or printer. Details of the design of various types of sheet handling apparatus are well known in the art and need not be discussed here for an understanding of the subject invention.

Apparatus 40 includes input 42 for input of a control signal for controlling the processing rate at which apparatus 40 operates. The control signal may apply to apparatus 40 as a whole if it is synchronous, or to critical operations of apparatus 40 if it is asynchronous.

Apparatus 40 also includes input 44 for input of an outstacking signal for controlling apparatus 40 to divert sheets from the normal processing path for corrective action.

Normally processed sheets are output at 46 and outstacked sheets are output at 48 for corrective action.

As sheet S is input A/D convertor 50 samples the drive current monitored by sensor 32 at a predetermined sequence of times to generate a predetermined sequence of digital samples which are output to buffer 60 for storage. Buffer 60 stores a predetermined number of samples, typically about 8, and outputs these samples to neural network 70 in parallel. Preferably these samples are normalized on a range from zero to one.

A/D converter 50 and buffer 60 operate in response to controller 80, which is responsive to motor controller 30 to assure proper timing of these samples.

Neural network 70 is connected to inputs 42 and 44 to generate a control signal for controlling the processing rate of apparatus 40 and an outstacking signal for diverting sheets for corrective action. Neural network 70 is trained in a conventional manner, which will be described further below, so that the control signal input at 42 will reduce the processing rate of apparatus 40 if sheet S is likely to jam; or, in extreme cases, the outstacking signal input at 44 will divert sheet S for corrective action.

In other embodiments of the subject invention neural network 70 may include a bias input 72 and an input EC representative of an external condition, as will be described further below.

Figure 2:
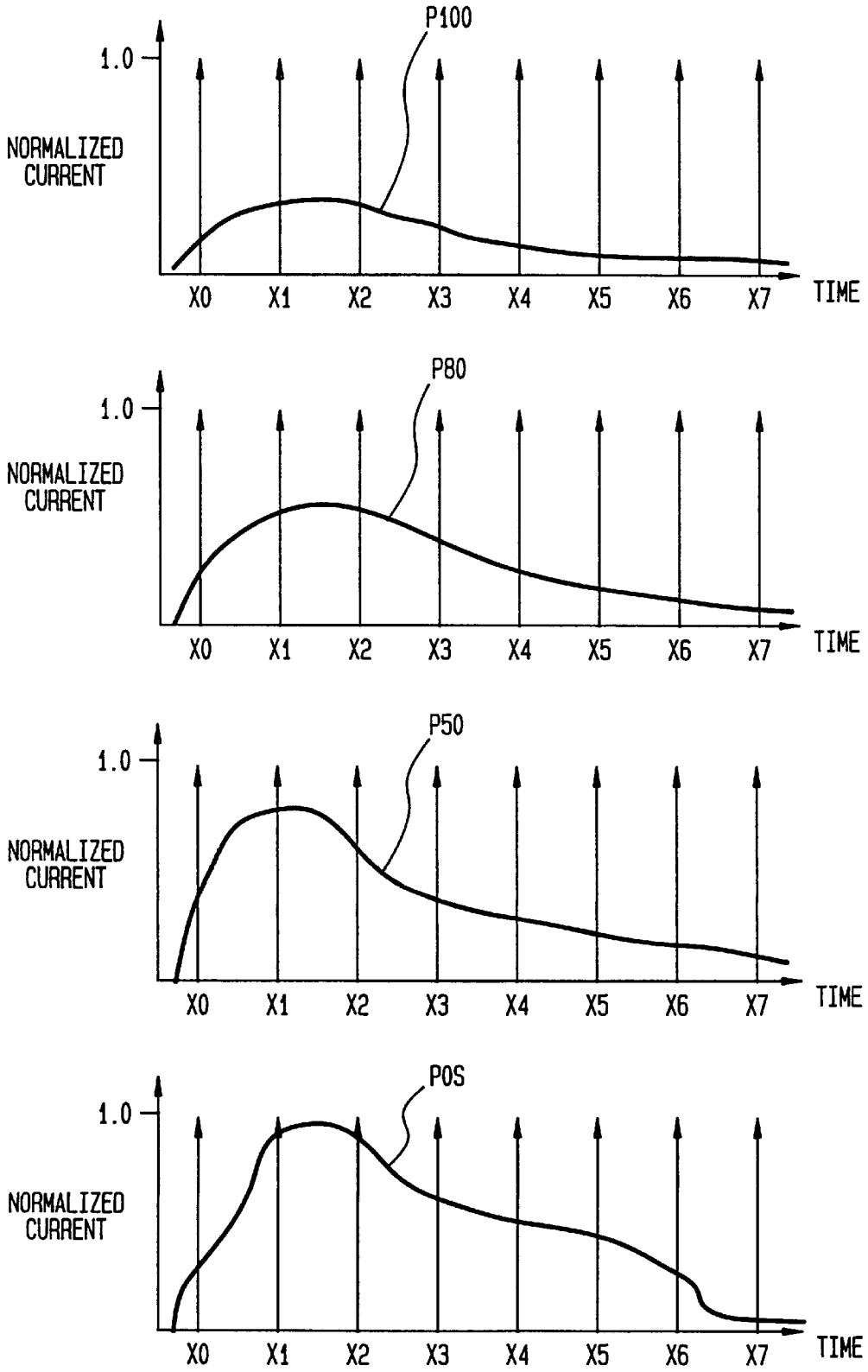
FIG. 2 illustrates a plurality of normalized current profiles.

Turning to FIG. 2 a plurality of hypothetical current profiles P100, P80, P50 and P0S are shown. These profiles are sampled at uniform time interval to generate 8 normalized samples X0–X7 representative of the value of the drive current measured by sensor 32 at equal intervals during the input of sheet S. P100 illustrates a profile of the drive current for a sheet which is well within tolerances and were apparatus 40 would operate at 100% of normal operating speed. Profile P80 represents a current profile where sheet S is somewhat out of tolerance and apparatus 40 would operate at 80% of normal operating speed.

Profile P50 represents a profile where sheet S is still further out of tolerance and apparatus 40 would operate at only 50% of normal speed. Finally, profile P0S represents the current profile for sheet S which is so far out of tolerance that it is outstacked.

It should be recognized that greater and smaller numbers of samples are within the contemplation of the subject invention, as is a non-uniformed distribution of the samples; perhaps with samples concentrated during portions of the input cycle which are known to be critical.

While neural networks are preferred, it is also within the contemplation of the subject invention that other techniques may be used to associate current profiles with control and outstack signals. A data base of current profiles with associated output signal values can be cross-correlated with a current profile for sheet S to select values for the control signal and outstacking signal, or other known pattern recognition techniques may be used.

Figure 3:
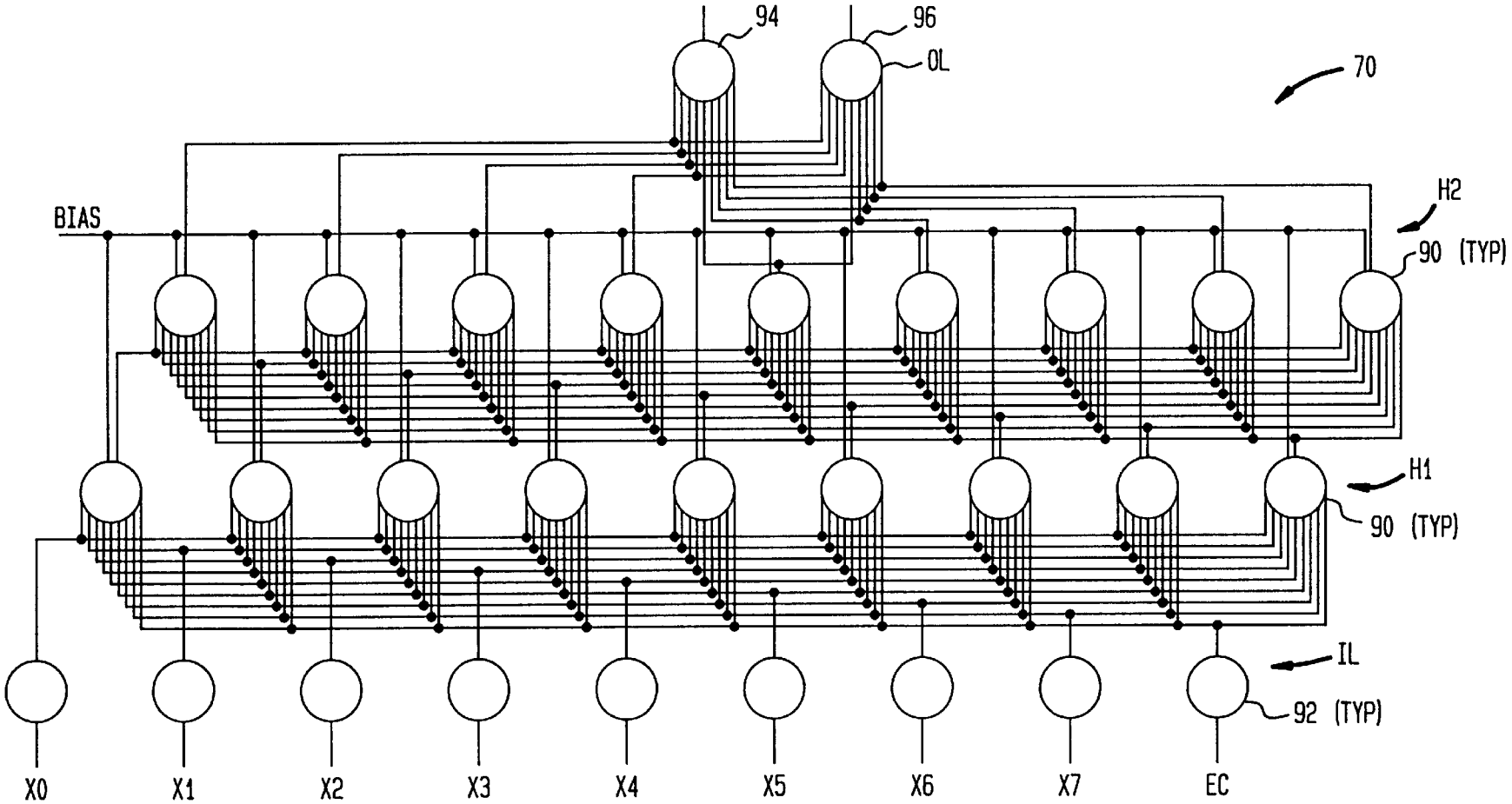
FIG. 3 shows a neural network used in an embodiment of the subject invention.

FIG. 3 shows a schematic of neural network 70. Network 70 comprises four layers: an input layer IL, an output layer OL, and two intermediate or "hidden" layers H1 and H2. Layers H1 and 2 each consist of nine identical neural nodes 90. Input layer IL consist of nine neural nodes 92 and output layer OL consist of nodes 94 and 96. Nodes 92, 94 and 96 are substantially the same as nodes 90, except for minor differences which will be described below.

Samples X0–X7 are input to 8 of nodes 92 comprised in input layer IL. In one embodiment of the subject invention an additional signal EC, representative of an external condition may be input through the last of nodes 92, as will be described further below. Each output of nodes 90 in layer IL is connected to an input of nodes 90 in hidden layer H1.

Each output of nodes 90 in layer H1 is connected to an input of each of nodes 90 in layer H2 and each output of nodes 90 in layer H2 is connected to an input of nodes 94 and 96.

Each of nodes 90 in layers H1 and H2 is also connected to a bias input, which will be described further below.

Figure 3A:
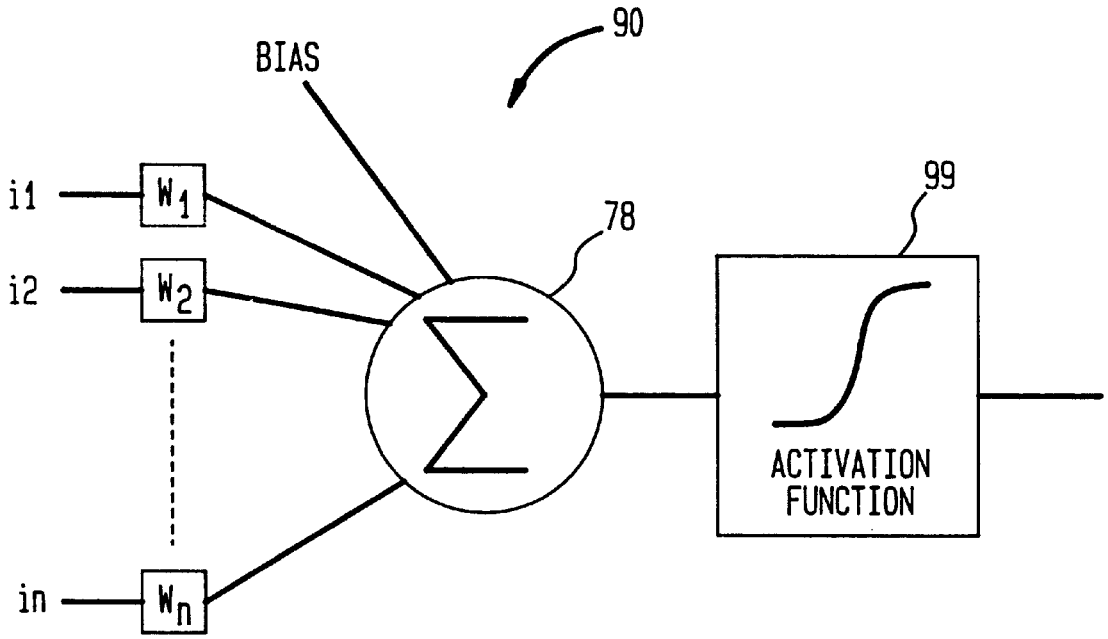
FIG. 3A (PRIOR ART)
FIG. 3*a* is a schematic representation of a conventional neural node.

Network 70 is trained in a conventional manner which will be described further below, so that node 94 generates the control signal to control apparatus 40 so that its processing rate is reduced if sheet S is likely to jam. Network 70 is also trained so that node 96 produces the outstacking signal to divert sheet S in extreme cases for corrective action. Turning to FIG. 3A a typical conventional node 90 is shown in schematic form each input i1–in is multiplied by a weighting factor w1–wn and summed at 98. This sum is input to activation function 99 to generate the output of the node 90. Activation function 99 may be any function which increases monotonically from zero to 1 or from minus 1 to 1. In a preferred embodiment of the subject invention a sigmoid function, $1/(1+e^{-x})$, is preferred. However, those skilled in the art will recognize that once network 70 is trained the sigmoid function may be replaced in fixed representations of the trained network with a linear approximation of the sigmoid function. Node 90 may also include a bias input. It is believed that input of a small value on the bias input decreases the amount of time needed to train network 70.

Nodes 92 in input layer H1 are substantially similar to nodes 90 except that, having only a single input and no bias input, no summation 98 is necessary. Node 94 differs from node 90 only in that activation function 99 may be omitted so that the control signal ranges over a broader range from zero to some maximum value. Node 96 differs from node 90 only in that the slope of activation function 99 is greatly increased over the transition range so that activation function 99 more nearly approximates a threshold function.

Training of network 70 consists of selection of values for each weight of each node in network 70 so that the desired functional relationship between the output and the inputs is established.

In one embodiment of the subject invention an additional input representative of an external condition may be supplied. It is believed that the likelihood that a given sheet S may jam is affected by external conditions such as temperature, humidity, or the operational history of apparatus 40. The affect of such external conditions may not be fully reflected in the characteristics signal from which samples X0–through X7 are generated; and thus it may be desirable to include an additional signal EC representative of the external condition. As can be seen from examination of FIG. 3, signal EC is processed identically to all other inputs, and thus need not be discussed separately here.

It should be noted that network 70 shown in the preferred embodiment of FIG. 3 is constructed using a known architecture, generally referred to as a "feed-forward network", and that other network architectures are known and are within the contemplation of the subject invention.

Figure 4:
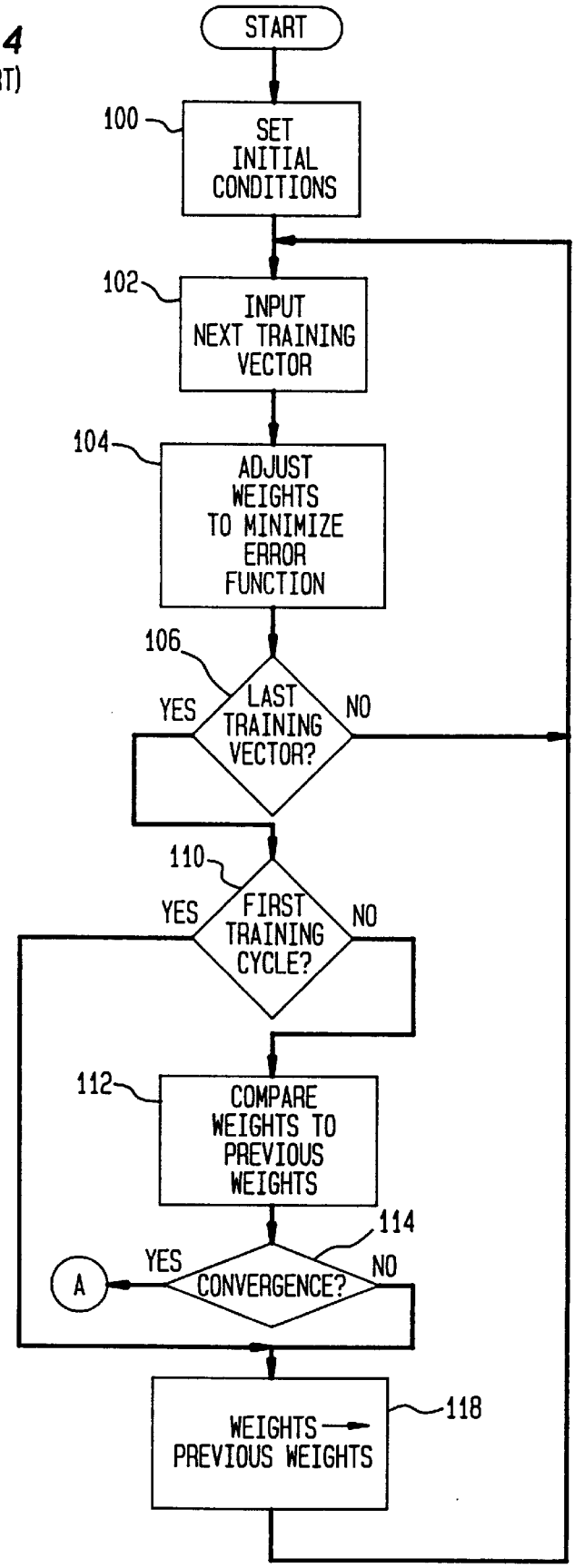
FIG. 4 (PRIOR ART)
FIGS. 4 and 5 shows a flow chart of a conventional method for training the neural network of FIG. 3.

Turning now FIG. 4 a conventional training algorithm for network 70 is shown. This algorithm is generally referred to as the back propagation algorithm and is commonly used with feed-forward networks.

To train networks 70 a set of training and test vectors is experimentally developed. In accordance with the subject invention this would be done by processing a variety of sheets through apparatus 40 and noting the processing rates at which various sheets jammed. By repeating these experiments with a large variety of sheets a set of training and test vectors, consisting of input vectors (i.e. inputs X0–X7, and possibly additional input EC) and output vectors (i.e. value the control signal and outstacking signal which have the desired functional relationship to the input vectors) is obtained. Of course, the training and test vectors must cover the desired range of operating conditions.

Once established the vectors are divided into a set of training vectors, and a smaller, representative set of test vectors which are used to confirm the training.

Turning to FIG. 4, at 100 the initial conditions for training are set. Initial values for all weights in network 70 are randomly set, if a bias is used, the bias is set to a small, random value, typically from 0.1 to 0.3. Then at 102 the next training vector is input. The input vector comprised in the training vector is applied to the inputs of network 70 and the output vector generated by network 70 is subtracted from the output vector comprised in the training vector to generate an error function. Then at 104 the weights are adjusted to minimize the error function. In accordance with the back propagation training algorithm this is achieved by taking the partial derivative of the error function with respect to each weight and making small adjustments to the weights in the direction of the negative slope for its derivative. This process is iterated until at least a local minimum is reached. The back propagation training algorithm is well known to those skilled in the art and is described in Zarade, "*Introduction to Artificial Neural Systems*", West Publishing Company (1992), and need not be discussed further here for an understanding of the invention.

Then, at 106, it is determined if this is the last training vector. If not, the algorithm returns to 102 to input the next training vector. If it is the last training vector then at 110 it is determined if this is the first training cycle. If it is then at 118 the algorithm stores the weights as previous weights and returns to 102 to begin the second cycle. Otherwise, at 112 the weights derived in the training cycle are compared to the previous weights, and at 114 a test is made for convergence. That is the weights are tested to see if each weight is equal to, or sufficiently close to, its corresponding previous weight so that it may safely be assumed that further training will not result in further changes to the weights. If the weights have not converged the algorithm returns through 118 to 102 for another training cycle. If the weights have converged then the algorithm proceeds to A in FIG. 5 to test network 70.

Figure 5:
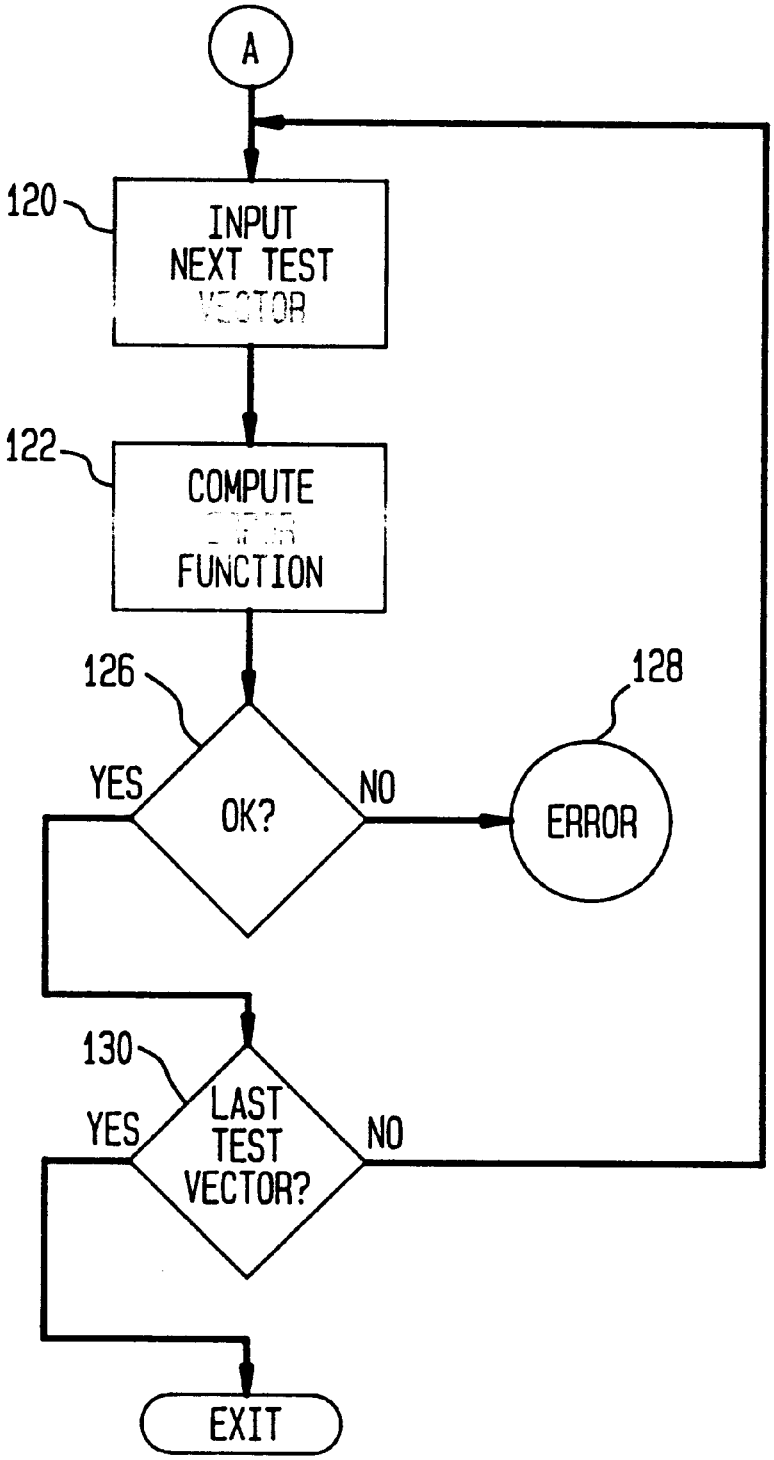
FIG. 5 (PRIOR ART)

At 120 in FIG. 5, the next test vector is input and at 122 the error function (i.e. the difference between the output of network 70 and the output vector comprised in the test vector) is computed. Then 126 the error function is tested to determine if the difference is less than a predetermined allowable amount. If it is not then an error in training has occurred and appropriate corrective action is needed. Then at 130, if it is not the last test vector the algorithm returns to 120 to input the next test vector. When the last test vector is appropriately checked then the algorithm exits.

Figure 6:
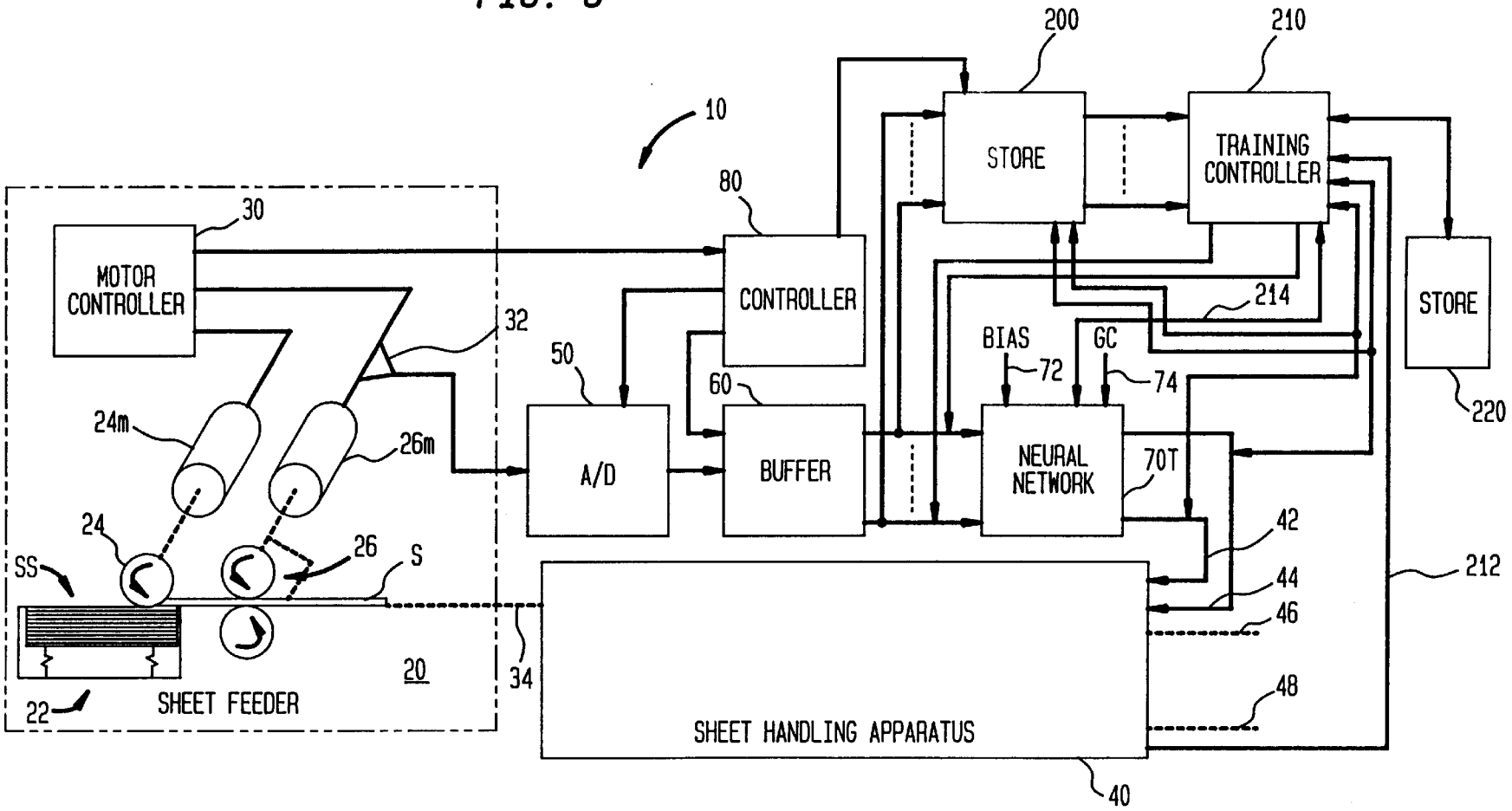
FIG. 6 shows a schematic block diagram of another system in accordance with the subject invention.

FIG. 6 shows another embodiment of the subject invention in which neural network 70T may be adaptively trained in the course of normal operation of system 10. Neural network 70T is architecturally and functionally identical to network 70 described above, and differs only in that weights for network 70T are stored in writeable storage and maybe modified as system 10 is adaptively trained, as will be described further below.

Store 200 is connected to the inputs and outputs of network 70T and is responsive to controller 80 to store the input and output values of network 70T for at least the last sheet fed and preferably a predetermined number of previous sheets. Training controller 210 is connected to store 200 and is responsive to a jam detect signal on line 212 to initiate further, adaptive training of neural network 70T, as will be described further below. Training controller 210 is connected to network 70T by bus 214 to allow uploading and downloading of weight values for network 70 T.

When a jam signal is detected on line 212 controller 210 may initiate training in accordance with predetermined conditions. Controller 210 may begin training after each jam, may indicate the occurrence of the jam to an operator and initiate training in response to an operator input, or may examine inputs and outputs for previous sheets to attempt to determine if similar jams have occurred previously and initiate training only if a particular type of sheet appears to be jamming with an unacceptably high frequency.

In a preferred embodiment system 10 may also include store 220 for storing the initial set of weight values of neural network 70T prior to adaptive training. It is possible that a jam may occur for anomalous reasons such as feeding of two sheets which are clipped or stapled together; in which case it is likely that adaptive training will lead to an overall degradation of the operation of system 10. In such case store 220 allows the initial values for the weights to be restored if training does not result in an overall improvement in the operation of system 10.

Figure 7:
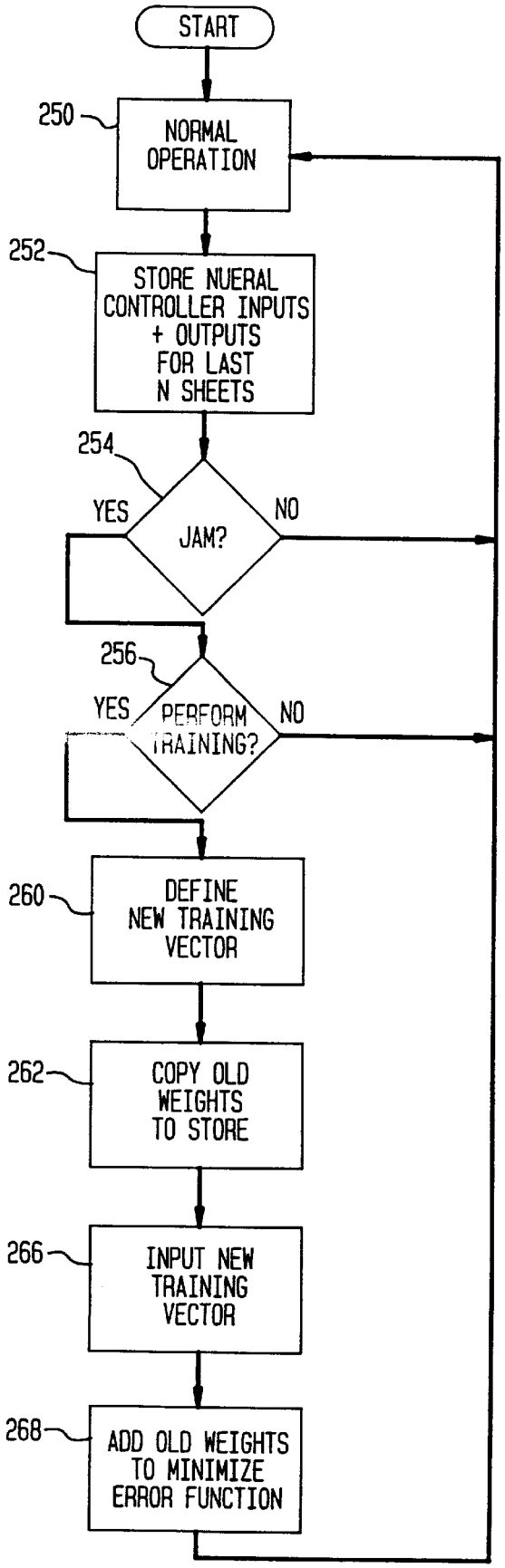
FIG. 7 shows a flow chart of a method for adaptively training the system of FIG. 6.

Turning to FIG. 7 a flow chart of the operation of system 10 in executing adaptive training of neural network 70T is shown.

At 250 sheet handling apparatus 40 is in a normal operating mode. At 252 store 200 is loaded with values for the inputs and outputs of network 70T for the last N sheets. At 254 training controller 210 determines if a jam signal is present on line 212. If no jam is detected the system returns to normal operation at 250. If a jam is detected, then at 258 the system determines if conditions are satisfied for the performance of adaptive training. If not, again the system returns to normal operation at 250.

If conditions for adaptive training are satisfied then at 260 training controller 210 defines a new training vector, which consists of the inputs for the last sheet (i.e., the sheet which jammed) and the outputs for the last sheet reduced by a predetermined increment. For example, if the last sheet which jammed was being processed at 100% of the nominal rate, this rate might be reduced to 80% for incorporation in the new training vector. Preferably then, at 262 the old weights for network 70T are copied into store 220 so that the initial state of network 70T may be restored if the training does not result in an improvement in the overall operation of system 10, as discussed above. Controller 210 then inputs the new training vector to neural network 70T at 266, and adjusts the old weights of network 70T to minimize the error function substantially in the manner shown in FIG. 4, with the exception that the set of training vectors consists of only the single new training vector. System 10 then returns to normal operation.

Those skilled in art will recognize that the above described initial training may most readily be carried out by simulation of network 70 on a properly programmed digital computer to determine appropriate values for the weights. Once these values have been determined they can be permanently stored in a fixed representation of network 70 which may then be installed in the system of FIG. 3.

The above description of preferred embodiments has been provided by way of illustration and explanation only. Numerous other embodiments of the subject invention will be apparent to those skilled in the art from the description provided above and the attached drawings. Accordingly, limitations on the subject invention are only to be found in the claims set forth below.

What is claimed is:

1. A method for controlling a sheet handling apparatus to reduce jams, comprising the steps of:

a) monitoring a characteristic signal produced during input of a sheet, said signal being characteristic of said sheet, and said characteristic signal being a drive current for a servo motor;

b) generating a control signal for controlling the processing rate of said apparatus in response to said characteristic signal so that the processing rate is reduced if said sheet is likely to jam in said apparatus, wherein said generating step further comprises:

1) sampling said characteristic signal to provide a sequence of samples; and, 2) inputting said sequence of samples to a neural network, said neural network responding to said sequence to generate said control signal for controlling the processing rate of said apparatus.

* * * * *